US010577681B2

(12) United States Patent
McColvin et al.

(10) Patent No.: US 10,577,681 B2
(45) Date of Patent: Mar. 3, 2020

(54) NICKEL-IRON-COBALT BASED ALLOYS AND ARTICLES AND METHODS FOR FORMING ARTICLES INCLUDING NICKEL-IRON-COBALT BASED ALLOYS

(71) Applicant: GENERAL ELECTRIC COMPANY, Schenectady, NY (US)

(72) Inventors: Gordon McColvin, Bolsover (GB); Jean Laragne, Baar (CH); Giovanni Cataldi, Zurich (CH)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 214 days.

(21) Appl. No.: 15/642,960

(22) Filed: Jul. 6, 2017

(65) Prior Publication Data

US 2019/0010584 A1 Jan. 10, 2019

(51) Int. Cl.
*C22C 30/00* (2006.01)
*B22D 13/04* (2006.01)
(Continued)

(52) U.S. Cl.
CPC ..... *C22C 30/00* (2013.01); *B22D 13/04* (2013.01); *C21D 6/001* (2013.01); *C21D 6/007* (2013.01);
(Continued)

(58) Field of Classification Search
None
See application file for complete search history.

(56) References Cited

U.S. PATENT DOCUMENTS 4,765,956 A * 8/1988 Smith ..... C22C 19/05 420/445
5,688,471 A * 11/1997 Smith ..... C22C 38/08 420/581
(Continued)

FOREIGN PATENT DOCUMENTS

JP 07179984 A * 7/1995

OTHER PUBLICATIONS

Machine Translation of JP 07-179984 (Translated Aug. 2, 2019) (Year: 1995).*
(Continued)

*Primary Examiner* — David Sample
*Assistant Examiner* — Elizabeth Collister
(74) *Attorney, Agent, or Firm* — McNees Wallace & Nurick LLC

(57) ABSTRACT

Nickel-iron-cobalt based alloys are disclosed having sufficient castability for centrifugal casting essentially free from casting defects, cracking, and microstructure variability, and coefficients of thermal expansion up to about $9\times10^{-6}/°$ C. for about 100-400° C. and increasing from about 400-500° C. to up to about $10\times10^{-6}/°$ C., or up to about $6\times10^{-6}/°$ C. between about 100-300° C. and increasing from about 300-500° C. to up to about $10\times10^{-6}/°$ C. Articles are disclosed including unitary cast structures free of internal welds, brazing, and bolting, essentially annular conformations, diameters of at least about 500 mm, cross-sectional wall areas of at least about 2,000 mm$^2$, and compositions including nickel-iron-cobalt based alloys. Methods for forming the articles are disclosed including rotating centrifugal molds with the compositions in molten states, forming the articles in near net shape.

24 Claims, 2 Drawing Sheets

(51) Int. Cl.

| | |
|---|---|
| ***C21D 6/02*** | (2006.01) |
| ***C21D 6/00*** | (2006.01) |
| ***C21D 9/40*** | (2006.01) |
| ***C22C 19/03*** | (2006.01) |

(52) U.S. Cl.
CPC ..... *C21D 6/02* (2013.01); *C21D 9/40* (2013.01); *C22C 19/03* (2013.01)

(56) References Cited

U.S. PATENT DOCUMENTS

| | | | | |
|---|---|---|---|---|
| 2004/0197220 | A1* | 10/2004 | Katsuragi | C22C 30/00 420/97 |
| 2010/0031671 | A1 | 2/2010 | Chehab et al. | |
| 2012/0045312 | A1 | 2/2012 | Kimmel et al. | |
| 2016/0177768 | A1* | 6/2016 | Borja | F01D 5/02 415/134 |

OTHER PUBLICATIONS

F. C. Hull, et al., Effect of Composition on Thermal Expansion of Alloys Used in Power Generation, J. Materials Engineering, 1987, vol. 9, No. 1.

Daniel Lorstad, et al., Siemens Gas Turbine SGT-800 Enhanced to 50MW: Design Modifications, Validation and Operation Experience, Siemens Industrial Turbomachinery AB SE 612 83, Finspong, Sweden.

* cited by examiner

NICKEL-IRON-COBALT BASED ALLOYS AND ARTICLES AND METHODS FOR FORMING ARTICLES INCLUDING NICKEL-IRON-COBALT BASED ALLOYS

FIELD OF THE INVENTION

The present invention is directed to nickel-iron-cobalt based alloys, articles including nickel-iron-cobalt based alloys, and methods for forming articles including nickel-iron-cobalt based alloys. More particularly, the present invention is directed to nickel-iron-cobalt based alloys, articles including nickel-iron-cobalt based alloys, and methods for forming articles including nickel-iron-cobalt based alloys with low coefficients of thermal expansion.

BACKGROUND OF THE INVENTION

Turbomachines, such as, but not limited to, gas turbines, steam turbines, compressors, expanders, and pumps, may include components such as casings and carrier rings which are essentially annular and require sufficient strength at high temperatures to meet the operational requirements for gas turbines.

The use of low coefficient of thermal expansion materials for casings, shells, and carrier rings may lead to significant benefits in the reduction of compressor and turbine blade and vane tip clearances which produces increased power and efficiency, however low coefficient of thermal expansion materials are typically expensive nickel-based alloys which must be produced as wrought products which are direct ring rolled or flashbutt welding rings at a commercial scale. Section sizes produced from these materials by these methods are often too small for gas turbine casing and carrier ring dimensions, and must therefore be assembled circumferentially by joining techniques such as arc welding and flanging with welding or bolting.

BRIEF DESCRIPTION OF THE INVENTION

In an exemplary embodiment, a nickel-iron-cobalt based alloy includes, by weight: about 36.0-40.0% nickel; about 13.0-17.0% cobalt; about 2.0-2.8% niobium; about 0.5-1.15% aluminum; about 1.0-1.8% titanium; about 0.1-0.4% tantalum; up to about 0.5% silicon; and a balance of iron of about 36.0-45.0%. The nickel-iron-cobalt based alloy has sufficient castability for centrifugal casting essentially free from casting defects, cracking, and microstructure variability. The nickel-iron-cobalt based alloy further has a coefficient of thermal expansion up to about $9\times10^{-6}/°$ C. for temperatures between about 100° C. to about 400° C., and increasing from about 400° C. to about 500° C. to up to about $10\times10^{-6}/°$ C.

In another exemplary embodiment, a nickel-iron-cobalt based alloy includes, by weight: about 42.5-44.0% nickel; about 2.2-2.5% cobalt; about 1.8-2.6% niobium; about 0.05-0.2% aluminum; about 0.2-0.5% tantalum; up to about 0.3% silicon; and a balance of iron of about 50.0-54.0%. The nickel-iron-cobalt based alloy has sufficient castability for centrifugal casting essentially free from casting defects, cracking, and microstructure variability. The nickel-iron-cobalt based alloy further has a coefficient of thermal expansion up to about $6\times10^{-6}/°$ C. for temperatures between about 100° C. to about 300° C., and increasing from about 300° C. to about 500° C. to up to about $10\times10^{-6}/°$ C.

In another exemplary embodiment, an article includes a unitary cast structure essentially free from casting defects, cracking, and microstructure variability, an essentially annular conformation, a diameter of at least about 500 mm, a cross-sectional wall area of the unitary cast structure of at least about 2,000 $mm^2$, and a composition including a nickel-iron-cobalt based alloy. The unitary cast structure is free of internal welds, internal brazing, and internal bolting.

In another exemplary embodiment, a method for forming an article includes disposing a composition in a molten state into a centrifugal mold, rotating the centrifugal mold with the composition under an atmosphere, cooling the composition alloy to a solid state, forming the article, and removing the article from the centrifugal mold in near net shape. The composition includes a nickel-iron-cobalt based alloy. The article includes a unitary cast structure essentially free from casting defects, cracking, and microstructure variability, an essentially annular conformation, a diameter of at least about 500 mm, a cross-sectional wall area of the unitary cast structure of at least about 2,000 $mm^2$, and the composition including the nickel-iron-cobalt based alloy.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
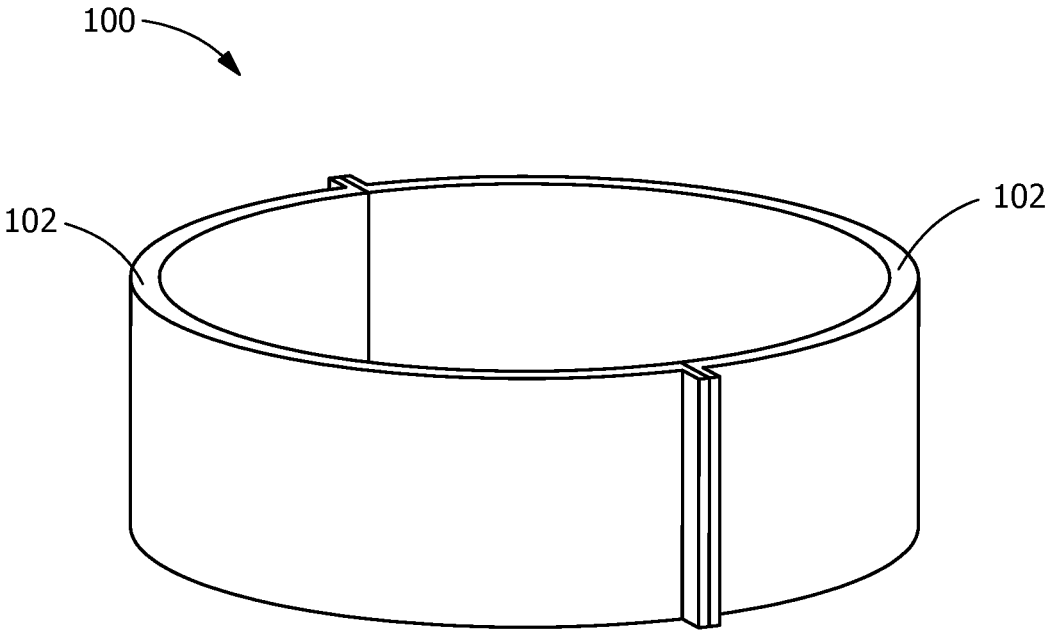
Prior Art FIG. 1
FIG. 1 is a prior art article.

Provided are exemplary nickel-iron-cobalt based alloys, articles including nickel-iron-cobalt based alloys, and methods for forming articles including nickel-iron-cobalt based alloys. Embodiments of the present disclosure, in comparison to articles and methods not utilizing one or more features disclosed herein, decrease costs, increase production efficiency, increase operational power, decrease part complexity, increase part durability, decrease clearances, allow design for tighter running radial clearances, modify relative movements between parts (e.g., between concentric shells, at least one of which includes the nickel-iron-cobalt based alloys), increase strength, reduce or eliminate welding and associated distortion and integrity issues, reduce machining, avoid double melt, reduce machining external features, reduce or eliminate porosity and center line shrinkage, or combinations thereof.

In one embodiment, a nickel-iron-cobalt based alloy includes, by weight, about 36.0-40.0% nickel, about 13.0-17.0% cobalt, about 2.0-2.8% niobium, about 0.5-1.15% aluminum, about 1.0-1.8% titanium, about 0.1-0.4% tantalum, up to about 0.5% silicon, and a balance of iron of about 36.0-45.0%. In a further embodiment, the nickel-iron-cobalt based alloy consists essentially of, alternatively consists of, by weight, 36.0-40.0% nickel, 13.0-17.0% cobalt, 2.0-2.8% niobium, 0.5-1.15% aluminum, 1.0-1.8% titanium, 0.1-0.4% tantalum, up to 0.5% silicon, and a balance of iron of 36.0-45.0%. Embodiments including or consisting essentially of the listed elements may further include up to about 2% incidental impurities, alternatively up to about 1% incidental impurities, alternatively up to about 0.5% incidental impurities, alternatively up to about 0.1% incidental impurities. Incidental impurities are elements other than the listed elements which are present in concentrations below a threshold at which the elements would have a material effect on the physical characteristics of the nickel-iron-cobalt based alloy. In a further embodiment, nickel-iron-cobalt based alloys including or consisting essentially of the listed elements may include, but not exceed, as a portion of the incidental impurities up to about 50 ppm total, and up to about 10 ppm individually, tramp elements, wherein the tramp elements are lead, tin, selenium, bismuth, thallium, antimony, silver, and other elements having similar effects on the alloy. In yet a further embodiment, the tramp elements are limited to lead, tin, selenium, bismuth, thallium, antimony, and silver.

In another embodiment, a nickel-iron-cobalt based alloy includes, by weight, about 42.5-44.0% nickel, about 2.2-2.5% cobalt, about 1.8-2.6% niobium, about 0.05-0.2% aluminum, about 0.2-0.5% tantalum, up to about 0.3% silicon, and a balance of iron of about 50.0-54.0%. In a further embodiment, the nickel-iron-cobalt based alloy consists essentially of, alternatively consists of, by weight, 42.5-44.0% nickel, 2.2-2.5% cobalt, 1.8-2.6% niobium, 0.05-0.2% aluminum, 0.2-0.5% tantalum, up to 0.3% silicon, and a balance of iron of 50.0-54.0%. Embodiments including or consisting essentially of the listed elements may further include up to about 2% incidental impurities, alternatively up to about 1% incidental impurities, alternatively up to about 0.5% incidental impurities, alternatively up to about 0.1% incidental impurities. In a further embodiment, nickel-iron-cobalt based alloys including or consisting essentially of the listed elements may include, but not exceed, as a portion of the incidental impurities up to about 50 ppm total, and up to about 10 ppm individually, tramp elements, wherein the tramp elements are lead, tin, selenium, bismuth, thallium, antimony, and silver.

The nickel-iron-cobalt based alloy has sufficient castability for centrifugal casting, such that a casting formed from the nickel-iron-cobalt based alloy would be essentially free from casting defects, cracking, and microstructure variability. As used herein, to be essentially free from casting defects, cracking, and microstructural variability indicates that any casting defects, cracking, or microstructural variability is within the production tolerances and operational tolerances of the casting. In a further embodiment, to be essentially free from casting defects, cracking, and microstructural variability indicates that any casting defects, cracking, or microstructural variability is within the production tolerances and operational tolerances of a gas turbine casing or carrier ring.

The nickel-iron-cobalt based alloy has a coefficient of thermal expansion up to about $9\times10^{-6}$/° C. for temperatures between about 100° C. to about 400° C., and increasing from about 400° C. to about 500° C. to up to about $10\times10^{-6}$/° C. In a further embodiment, the nickel-iron-cobalt based alloy has a coefficient of thermal expansion up to about $6\times10^{-6}$/° C. for temperatures between about 100° C. to about 300° C., and increasing from about 300° C. to about 500° C. to up to about $10\times10^{-6}$/° C.

Referring to FIG. 1, in a non-inventive embodiment, a flanged ring 100 is divided into a plurality of segments 102. The plurality of segments 102 may be joined to one other by welding, bolting, or any other suitable technique to form the flanged ring 100.

Figure 2:
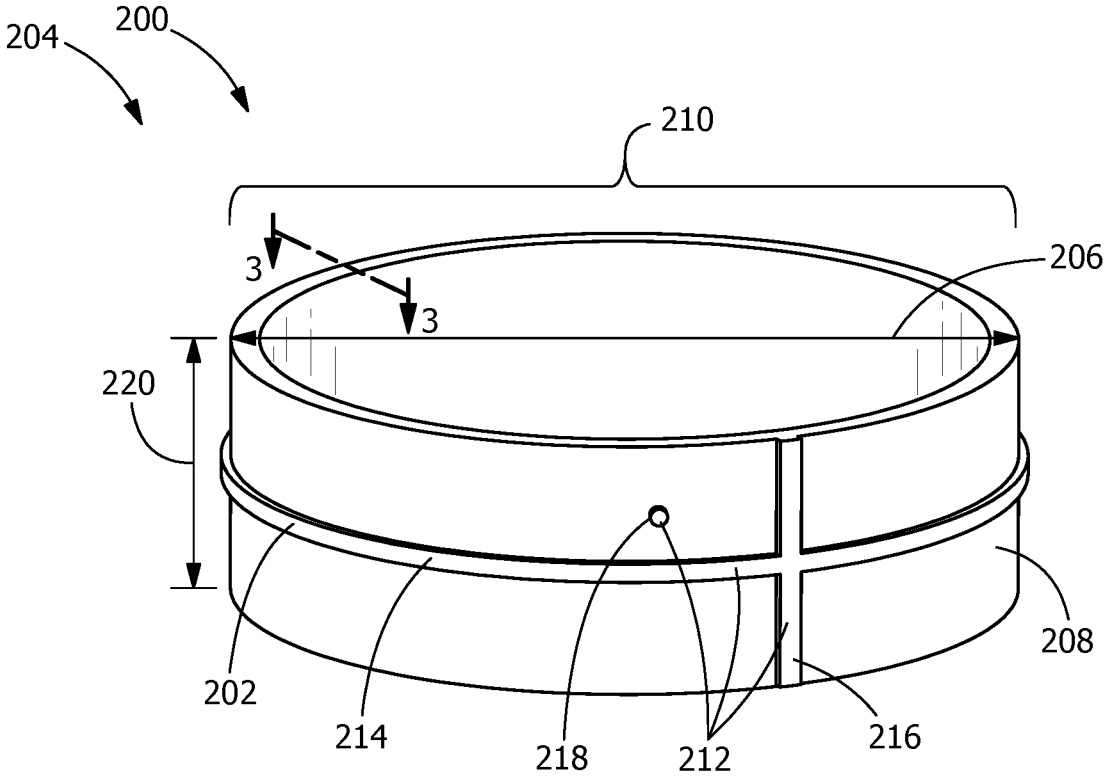
FIG. 2 is a perspective view of an article, according to an embodiment of the present disclosure.
Figure 3:
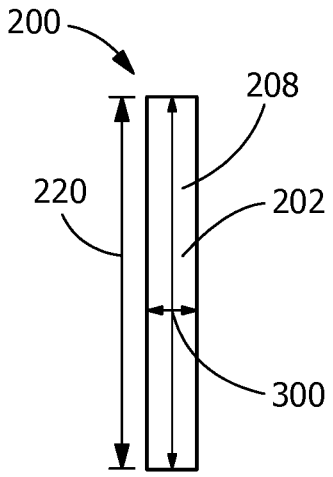
FIG. 3 is a cross-section view of the article of FIG. 2 along lines 2-2, according to an embodiment of the present disclosure.

Referring to FIGS. 2 and 3, in one embodiment, an article 200 includes a unitary cast structure 202, an essentially annular conformation 204, a diameter 206 of at least about 500 mm, a cross-sectional wall area 300 of the unitary cast structure 202 of at least about 2,000 $mm^2$, and a composition 208 including, alternatively consisting of, a nickel-iron-cobalt based alloy. The unitary cast structure 202 is free of internal welds, internal brazing, and internal bolting, and is essentially free from casting defects, cracking, and microstructure variability. The nickel-iron-cobalt based alloy may be any nickel-iron-cobalt based alloy described herein, or may be a distinct nickel-iron-cobalt based alloy from those described herein.

The "essentially" annular conformation 204 indicates that the article 200 may deviate from a perfect annulus in at least two respects. First, the essentially annular conformation 204 may include de minimus deviations from a perfect annular shape. Second, in addition to a primary annular portion 210, the article 200 may include at least one exterior surface feature 212, such as, but not limited to, a circumferential extension 214, a radial extension 216, a local extension 218, or combinations thereof.

The diameter 206 of the article 200 may be any suitable diameter 206, including, but not limited to, at least about 500 mm, at least about 1,000 mm, alternatively at least about 1,500 mm, alternatively at least about 2,000 mm, alternatively at least about 2,500 mm, alternatively at least about 3,000 mm, alternatively at least about 3,500 mm, alternatively at least about 4,000 mm.

The cross-sectional wall area 300 of the article 200 may be any suitable cross-sectional wall area 300, including, but not limited to, at least about 2,000 $mm^2$, alternatively at least about 2,500 $mm^2$, alternatively at least about 3,000 $mm^2$, alternatively at least about 3,500 $mm^2$, alternatively at least about 4,000 $mm^2$, alternatively at least about 4,500 $mm^2$, alternatively at least about 5,000 $mm^2$, alternatively at least about 5,500 $mm^2$, alternatively at least about 6,000 $mm^2$, alternatively at least about 6,500 $mm^2$, alternatively at least about 7,000 $mm^2$, alternatively at least about 7,500 $mm^2$, alternatively at least about 8,000 $mm^2$, alternatively at least about 8,500 $mm^2$, alternatively at least about 9,000 $mm^2$, alternatively at least about 9,500 $mm^2$, alternatively at least about 10,000 $mm^2$, alternatively at least about 11,000 $mm^2$, alternatively at least about 12,000 $mm^2$, alternatively at least about 15,000 $mm^2$, alternatively at least about 20,000 $mm^2$, alternatively at least about 25,000 $mm^2$.

The article 200 may include any suitable length 220, including, but not limited to, a length 220 of a least about 10 mm, alternatively at least about 25 mm, alternatively at least about 50 mm, alternatively at least about 75 mm, alternatively at least about 100 mm, alternatively at least about 125 mm, alternatively at least about 150 mm, alternatively at least about 175 mm, alternatively at least about 200 mm, alternatively at least about 500 mm, alternatively at least about 1,000 mm, alternatively at least about 2,000 mm, alternatively at least about 5,000 mm.

The article 200 may be any suitable component, including, but not limited to, a turbomachine component, a gas turbine component, a steam turbine component, an expander component, a compressor component, a pump component, a ring, a carrier ring, a casing, a shell, a bar, a skeleton of bars and rings, or combinations thereof.

In one embodiment, the composition 208 has a coefficient of thermal expansion up to about $9\times10^{-6}$/° C. for temperatures between about 100° C. to about 400° C., and increasing from about 400° C. to about 500° C. to up to about $10\times10^{-6}$/° C. In a further embodiment, the composition 208 has a coefficient of thermal expansion up to about $6\times10^{-6}$/° C. for temperatures between about 100° C. to about 300° C., and increasing from about 300° C. to about 500° C. to up to about $10\times10^{-6}$/° C.

Figure 4:
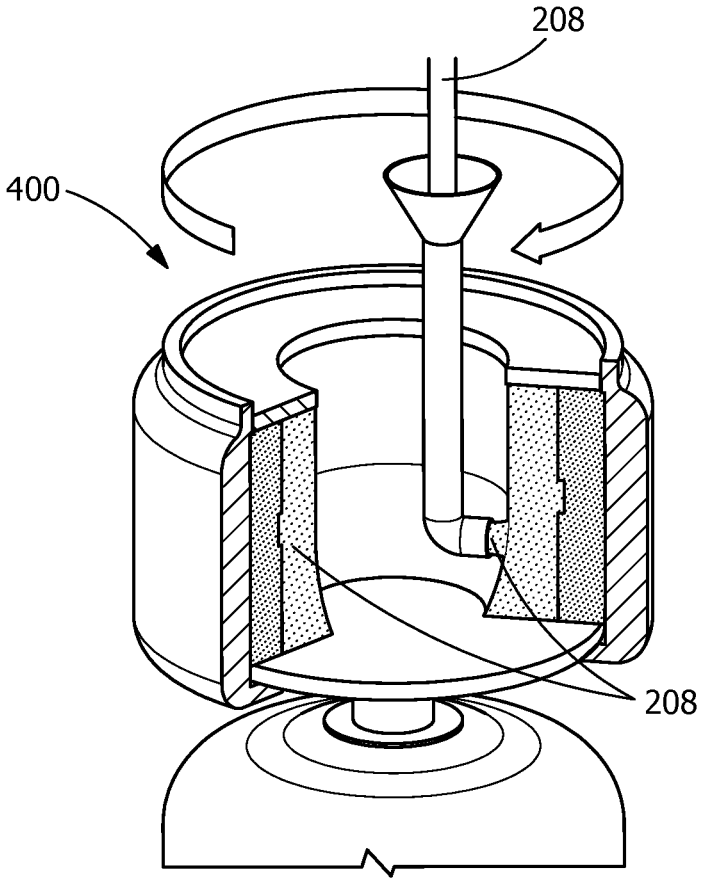
FIG. 4 is a perspective view of the casting of the article of FIG. 2, according to an embodiment of the present disclosure.

Referring to FIGS. 2 and 4, in one embodiment, a method for forming an article 200 includes disposing a composition 208 in a molten state into a centrifugal mold 400. The composition 208 include a nickel-iron-cobalt based alloy, which may be any nickel-iron-cobalt based alloy described herein, or may be a distinct nickel-iron-cobalt based alloy from those described herein. The centrifugal mold 400 is rotated with the composition 208 under an atmosphere, and the composition 208 is cooled to a solid state, forming the article 200. The article 200 is removed from the centrifugal mold 400 in near net shape.

The centrifugal mold 400 may be rotated at any suitable rotational velocity, including, but not limited to, a rotational velocity which generates a centrifugal force of between about 10 g to about 125 g, alternatively between about 15 g to about 100 g, alternatively between about 20 g to about 50 g, alternatively between about 15 g to about 35 g, alternatively between about 25 g to about 45 g, alternatively between about 35 g to about 55 g, alternatively between about 45 g to about 65 g, alternatively between about 55 g to about 75 g, alternatively between about 65 g to about 85 g, alternatively between about 75 g to about 95 g, alternatively between about 85 g to about 105 g, alternatively between about 95 g to about 115 g, alternatively between about 105 g to about 125 g.

The article 200 may be solutioned at any suitable solutioning temperature, including but not limited to, a solutioning temperature between about 1,000° C. to about 1,300° C., alternatively between about 1,050° C. to about 1,250° C., alternatively between about 1,000° C. to about 1,100° C., alternatively between about 1,050° C. to about 1,150° C., alternatively between about 1,100° C. to about 1,200° C., alternatively between about 1,150° C. to about 1,250° C. The solutioning treatment may include any suitable duration, including a duration between about 0.5 hours to about 12 hours, alternatively between about 1 hour to about 8 hours, alternatively between about 1 hour to about 4 hours, alternatively between about 3 hours to about 7 hours, alternatively between about 6 hours to about 12 hours.

The article 200 may be precipitation treated at any suitable precipitation temperature in one or more stages, including but not limited to, a precipitation temperature between about 550° C. to about 800° C., alternatively between about 600° C. to about 750° C., alternatively between about 550° C. to about 650° C., alternatively between about 600° C. to about 700° C., alternatively between about 650° C. to about 750° C. The precipitation treatment may include any suitable duration, including a duration between about 2 hours to about 22 hours, alternatively between about 4 hours to about 20 hours, alternatively between about 2 hours to about 10 hours, alternatively between about 6 hours to about 14 hours, alternatively between about 10 hours to about 18 hours, alternatively between about 14 hours to about 22 hours. In one embodiment in which the precipitation treatment occurs in more than one stage, the stages may be separated by a controlled cooling period. The precipitation treatment may follow the solutioning treatment.

In one embodiment, post-casting machining may be limited to polishing, and adjustment of exterior surface features 212. In another embodiment, the article 200 may be machined post-casting on any suitable surface to form any suitable feature, provided that, by volume, less than about 10% of the near net shape as-cast article 202 is removed, alternatively less than about 5%, alternatively less than about 2%, alternatively less than about 1%, alternatively less than about 0.5%. Referring to FIG. 1, in one embodiment, the machining the article 200 may include dividing the article 200 into a plurality of segments 102, which may or may not be rejoined to one another, by way of example only, with bolts or welding.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A nickel-iron-cobalt based alloy, consisting of, by weight:

about 36.0-40.0% nickel;
about 13.0-17.0% cobalt;
about 2.0-2.8% niobium;
about 0.5-1.15% aluminum;
about 1.0-1.8% titanium;
about 0.1-0.4% tantalum;
up to about 0.5% silicon;
up to about 2% incidental impurities; and
a balance of iron of about 36.0-45.0%.

2. The nickel-iron-cobalt based alloy of claim 1, wherein the nickel-iron-cobalt alloy has:

sufficient castability for centrifugal casting essentially free from casting defects, cracking, and microstructure variability; and
a coefficient of thermal expansion up to about $9\times10^{-6}$/° C. for temperatures between about 100° C. to about 400° C., and increasing from about 400° C. to about 500° C. to up to about $10\times10^{-6}$/° C.

3. The nickel-iron-cobalt based alloy of claim 1, wherein the incidental impurities include up to about 50 ppm total, and up to about 10 ppm individually, of tramp elements selected from the group consisting of lead, tin, selenium, bismuth, thallium, antimony, silver, and combinations thereof.

4. A nickel-iron-cobalt based alloy, consisting of, by weight:

about 42.5-44.0% nickel;
about 2.2-2.5% cobalt;
about 1.8-2.6% niobium;
about 0.05-0.2% aluminum;
about 0.2-0.5% tantalum;
up to about 0.3% silicon;
up to about 2% incidental impurities; and
a balance of iron of about 50.0-54.0%.

5. The nickel-iron-cobalt based alloy of claim 4, wherein the nickel-iron-cobalt alloy has:

sufficient castability for centrifugal casting essentially free from casting defects, cracking, and microstructure variability; and
a coefficient of thermal expansion up to about $6\times10^{-6}$/° C. for temperatures between about 100° C. to about 300°

C., and increasing from about 300° C. to about 500° C. to up to about $10\times10^{-6}$/° C.

6. The nickel-iron-cobalt based alloy of claim 4, wherein the incidental impurities include up to about 50 ppm total, and up to about 10 ppm individually, of tramp elements selected from the group consisting of lead, tin, selenium, bismuth, thallium, antimony, silver, and combinations thereof.

7. An article comprising:

a unitary cast structure essentially free from casting defects, cracking, and microstructure variability;

an essentially annular conformation;

a diameter of at least about 500 mm;

a cross-sectional wall area of the unitary cast structure of at least about 2,000 $mm^2$; and a nickel-iron-cobalt based alloy, wherein the unitary cast structure is free of internal welds, internal brazing, and internal bolting, and wherein the nickel-iron-cobalt based alloy consists of, by weight:

about 36.0-40.0% nickel;

about 13.0-17.0% cobalt;

about 2.0-2.8% niobium;

about 0.5-1.15% aluminum;

about 1.0-1.8% titanium;

about 0.1-0.4% tantalum;

up to about 0.5% silicon;

up to about 2% incidental impurities; and a balance of iron of about 36.0-45.0%.

8. The article of claim 7, wherein the diameter is at least about 1,500 mm.

9. The article of claim 8, wherein the diameter is at least about 2,500 mm.

10. The article of claim 7, wherein the cross-sectional wall area is at least about 5,000 $mm^2$.

11. The article of claim 10, wherein the cross-sectional wall area is at least about 7,500 $mm^2$.

12. The article of claim 7, further including a length of at least about 10 mm.

13. The article of claim 12, wherein the length is at least about 50 mm.

14. The article of claim 7, wherein the article is selected from the group consisting of a turbomachine component, a gas turbine component, a steam turbine component, an expander component, a compressor component, a pump component, a ring, a carrier ring, a casing, a shell, a bar, a skeleton of bars and rings, and combinations thereof.

15. The article of claim 14, wherein the article is a gas turbine component, and the gas turbine component is selected from the group consisting of a carrier ring, a casing, a shell, and combinations thereof.

16. The article of claim 7, wherein the nickel-iron-cobalt based alloy has a coefficient of thermal expansion up to about $9\times10^{-6}$/° C. for temperatures between about 100° C. to about 400° C., and increasing from about 400° C. to about 500° C. to up to about $10\times10^{-6}$/° C.

17. The article of claim 7, wherein the article consists of the unitary cast structure essentially free from casting defects, cracking, and microstructure variability; the essentially annular conformation; the diameter of at least about 500 mm; the cross-sectional wall area of the unitary cast structure of at least about 2,000 $mm^2$; and the nickel-iron-cobalt based alloy.

18. An article comprising:

a unitary cast structure essentially free from casting defects, cracking, and microstructure variability;

an essentially annular conformation;

a diameter of at least about 500 mm;

a cross-sectional wall area of the unitary cast structure of at least about 2,000 $mm^2$; and a nickel-iron-cobalt based alloy, wherein the unitary cast structure is free of internal welds, internal brazing, and internal bolting, and wherein the nickel-iron-cobalt based alloy consists of, by weight:

about 42.5-44.0% nickel;

about 2.2-2.5% cobalt;

about 1.8-2.6% niobium;

about 0.05-0.2% aluminum;

about 0.2-0.5% tantalum;

up to about 0.3% silicon;

up to about 2% incidental impurities; and a balance of iron of about 50.0-54.0%.

19. The article of claim 18, wherein the diameter is at least about 2,500 mm.

20. The article of claim 18, wherein the cross-sectional wall area is at least about 7,500 $mm^2$.

21. The article of claim 18, wherein the length is at least about 50 mm.

22. The article of claim 18, wherein the article is selected from the group consisting of a turbomachine component, a gas turbine component, a steam turbine component, an expander component, a compressor component, a pump component, a ring, a carrier ring, a casing, a shell, a bar, a skeleton of bars and rings, and combinations thereof.

23. The article of claim 22, wherein the article is a gas turbine component, and the gas turbine component is selected from the group consisting of a carrier ring, a casing, a shell, and combinations thereof.

24. The article of claim 18, wherein the nickel-iron-cobalt based alloy has a coefficient of thermal expansion up to about $6\times10^{-6}$/° C. for temperatures between about 100° C. to about 300° C., and increasing from about 300° C. to about 500° C. to up to about $10\times10^{-6}$/° C.

* * * * *